US009166379B2

(12) United States Patent
Shimamura

(10) Patent No.: US 9,166,379 B2
(45) Date of Patent: Oct. 20, 2015

(54) SPARK PLUG

(71) Applicant: NGK SPARK PLUG CO., LTD., Nagoya-shi, Aichi (JP)

(72) Inventor: Takuya Shimamura, Iwakura (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/417,321

(22) PCT Filed: Feb. 27, 2013

(86) PCT No.: PCT/JP2013/001142
§ 371 (c)(1),
(2) Date: Jan. 26, 2015

(87) PCT Pub. No.: WO2014/020785
PCT Pub. Date: Feb. 6, 2014

(65) Prior Publication Data

US 2015/0194792 A1 Jul. 9, 2015

(30) Foreign Application Priority Data

Jul. 30, 2012 (JP) ..... 2012-168666

(51) Int. Cl.

| | |
|---|---|
| ***H01T 13/20*** | (2006.01) |
| ***H01T 13/36*** | (2006.01) |
| ***F02P 13/00*** | (2006.01) |
| ***H01T 13/08*** | (2006.01) |
| ***H01T 13/34*** | (2006.01) |

(52) U.S. Cl.
CPC ..... *H01T 13/36* (2013.01); *F02P 13/00* (2013.01); *H01T 13/08* (2013.01); *H01T 13/34* (2013.01)

(58) Field of Classification Search
CPC ..... H01T 13/00; H01T 13/02; H01T 13/12; H01T 13/20; H01T 13/34; H01T 13/36
USPC ..... 313/118, 143
See application file for complete search history.

(56) References Cited

U.S. PATENT DOCUMENTS

| | | | | |
|---|---|---|---|---|
| 6,111,345 | A * | 8/2000 | Shibata et al. | 313/141 |
| 6,548,945 | B1 | 4/2003 | Tamura | 313/141 |
| 7,215,069 | B2 | 5/2007 | Suzuki | 313/143 |
| 7,703,428 | B2 | 4/2010 | Nakayama et al. | 123/169 R |

(Continued)

FOREIGN PATENT DOCUMENTS

| | | | |
|---|---|---|---|
| JP | 2001-118659 | 4/2001 | H01T 13/16 |
| JP | 2006-92956 | 4/2006 | H01T 13/36 |

(Continued)

OTHER PUBLICATIONS

International Search Report from corresponding International Patent Application No. PCT/JP2013/001142, dated May 14, 2013 (English-language translation provided).

*Primary Examiner* — Thomas A Hollweg
*Assistant Examiner* — Kevin Quarterman
(74) *Attorney, Agent, or Firm* — Kusner & Jaffe

(57) ABSTRACT

A spark plug includes an insulating insulator and a metal shell. The metal shell includes a caulking portion, a seat portion with a tapering surface, a thread portion with a thread size equal to or less than M12, and a protrusion. The insulating insulator includes a lock portion locked to the protrusion, and is secured to the metal shell in a state held between the caulking portion and the protrusion.

8 Claims, 11 Drawing Sheets

(56) References Cited

U.S. PATENT DOCUMENTS

| | | | | |
|---|---|---|---|---|
| 8,206,194 | B2 | 6/2012 | Mori et al. | 445/7 |
| 2006/0066196 | A1* | 3/2006 | Suzuki | 313/143 |
| 2007/0126330 | A1* | 6/2007 | Kuki et al. | 313/143 |
| 2008/0093964 | A1* | 4/2008 | Kawashima | 313/141 |
| 2009/0071429 | A1 | 3/2009 | Nakayama et al. | 123/169 R |
| 2011/0107588 | A1 | 5/2011 | Mori et al. | 29/592.1 |
| 2011/0181168 | A1* | 7/2011 | Nakamura et al. | 313/144 |
| 2011/0273074 | A1 | 11/2011 | Yamada et al. | 313/135 |
| 2012/0267995 | A1* | 10/2012 | Shimamura et al. | 313/143 |
| 2012/0306346 | A1 | 12/2012 | Kyuno et al. | 313/141 |
| 2013/0015756 | A1* | 1/2013 | Yamada et al. | 313/143 |

FOREIGN PATENT DOCUMENTS

| | | | |
|---|---|---|---|
| JP | 2009-87923 | 4/2009 | H01T 13/08 |
| JP | 2010-232192 | 10/2010 | H01T 13/20 |
| JP | 2011-103276 | 5/2011 | H01T 13/08 |
| JP | 2011-181213 | 9/2011 | H01T 13/20 |
| WO | WO 2010/084904 | 7/2010 | H01T 13/20 |

* cited by examiner

SPARK PLUG

RELATED APPLICATIONS

This application is a National Stage of International Application No. PCT/JP2013/001142 filed Feb. 27, 2013, which claims the benefit of Japanese Patent Application No. 2012-168666, filed Jul. 30, 2012.

FIELD OF THE INVENTION

The present invention relates to a spark plug for use in an internal combustion engine or the like.

BACKGROUND OF THE INVENTION

A spark plug is assembled to a combustion apparatus such as an internal combustion engine (an engine), and is used to ignite an air-fuel mixture or the like. Generally, the spark plug includes an insulator having an axial hole, a center electrode, and a metal shell main body. The axial hole extends in an axial direction. The center electrode is inserted into the tip end side of the axial hole. The metal shell main body is provided on the outer periphery of the insulator. A thread portion and a flange seat portion are formed on the outer peripheral surface of the metal shell. The thread portion is threadably mounted on a mounting hole of the combustion apparatus. The seat portion is positioned at a rear end side with respect to the thread portion, and projects radially outward.

Furthermore, a protrusion is formed on an inner peripheral surface of the metal shell at the tip end side with respect to the seat portion. The protrusion projects toward the inner peripheral side. A lock portion is disposed on the outer periphery of the insulator. The lock portion is locked on a locked surface of the protrusion directly or indirectly via a sheet packing and similar member. Additionally, at a rear end portion of the metal shell, a caulking portion is formed to be bent toward the inner peripheral side. The insulator is secured to the metal shell in a state held between the protrusion and the caulking portion (that is, in a state where an axial force is applied from the metal shell). Accordingly, the axial force applied to the insulator provides a sufficiently large contact pressure between the locked surface and the lock portion. As a result, this ensures good air tightness between the metal shell and the insulator.

In order to ensure excellent air tightness within the combustion chamber, a known technique includes a ring-shaped gasket disposed at a thread root, which is disposed at the rear end side of the thread portion. When the spark plug is mounted on the combustion apparatus, the gasket contacts the seating portion of the combustion apparatus. Additionally, one spark plug (what is called a conical seat type) is proposed to further improve the air tightness (for example, see JP-A-2011-103276). In this spark plug, the gasket is not provided, and the seat portion includes a tip end face as a tapering surface that is tapered off toward the tip end side in the axial direction. The tapering surface directly contacts the seating portion.

Additionally, a process (a caulking process) for forming the caulking portion is performed as follows to secure the insulator to the metal shell. That is, in a state where the insulator is inserted into the metal shell, a tip end portion of the metal shell is inserted into an insertion hole of a predetermined receiving die, thus holding the metal shell at the receiving die. At this time, the tapering surface contacts a tapered receiving surface, which connects to with an opening of the insertion hole and has the same slanted angle as a slanted angle of the tapering surface. Subsequently, an annular pressing die is used to apply a load to the rear end portion of the metal shell along the axial direction. Accordingly, the caulking portion is formed in the rear end portion of the metal shell, and the metal shell and the insulator are secured to each other. Note that a bulge portion is formed together with the caulking portion in the caulking process. The bulge portion is formed by deformation of a relatively thin portion positioned between the caulking portion and the seat portion in the metal shell, and projects toward the outer peripheral side. The formation of the bulge portion allows more surely applying the axial force to the insulator from the metal shell.

Now, in the conical seat type spark plug, when a load is applied to the metal shell in the caulking process, the seat portion and the protrusion may be deformed excessively. If excessive deformation occurs at the seat portion and the protrusion, the axial force applied to the insulator from the metal shell may be extremely decreased. As a result, this may cause decrease in air tightness between the metal shell and the insulator.

Even if the decrease in axial force can be reduced, when an area of the locked surface is excessively large compared with the size of the axial force, the contact pressure between the locked surface and the lock portion becomes low. Eventually, this may cause decrease in air tightness.

The present invention has been conceived to solve the above-mentioned problems. An advantage of the invention is a spark plug that more surely prevents deformation of a seat portion and a protrusion in a caulking process so as to ensure good air tightness between a metal shell and an insulator

SUMMARY OF THE INVENTION

Configurations suitable for achieving the above object will next be described in itemized form. If needed, operational advantages peculiar to the configurations will be described additionally.

Configuration 1. In accordance with a first aspect of the present invention, there is provided a spark plug having a tubular insulator and a tubular metal shell. The tubular insulator extends in an axial direction. The tubular metal shell is disposed at an outer periphery of the insulator. The metal shell includes a caulking portion, a bulge portion, a seat portion, a thread portion, and a protrusion. The caulking portion is disposed in a rear end portion of the metal shell. The caulking portion is bent toward an inner peripheral side. The bulge portion is positioned on a tip end side with respect to the caulking portion. The bulge portion projects toward an outer peripheral side. The seat portion is positioned on the tip end side with respect to the caulking portion. The thread portion is positioned on the tip end side with respect to the seat portion. The thread portion is threadably mounted on a mounting hole of a combustion apparatus. The protrusion is positioned at an inner periphery on the tip end side with respect to the seat portion. The protrusion projects toward the inner peripheral side. The insulator has an outer diameter gradually decreasing toward the tip end side. The insulator includes a lock portion directly or indirectly locked to the protrusion. The insulator is secured to the metal shell in a state held between the caulking portion and the protrusion. The seat portion has an outer diameter gradually decreasing toward the tip end side. The seat portion includes a tapering surface that at least partially contacts the seating portion of the combustion apparatus when the thread portion is threadably mounted in the mounting hole of the combustion apparatus. $SB/SC \geq 3.5$, $SB/LB \leq 12.0$, and $SC/LC \leq 12.0$ are satisfied in a case where: the thread portion has a thread size equal to or less than M12;

the tapering surface has an area of SB ($mm^2$); a length of a seat-portion outer peripheral surface along the axis is LB (mm) where the seat-portion outer peripheral surface is a surface extending from a rear end of the tapering surface toward the rear end side along the axis in the seat portion; a locked surface has an area of SC ($mm^2$), is positioned on the inner peripheral side with respect to a rear end of the lock portion in the protrusion, and locks the lock portion; and a protrusion inner peripheral surface has a length of LC (mm) along the axis and is a surface extending from a tip end of the locked surface toward the tip end side along the axis in the protrusion.

Note that "the seat-portion outer peripheral surface and the protrusion inner peripheral surface extend along the axis" includes not only the case where the seat-portion outer peripheral surface and similar member extend strictly along the axis, that is, the case where the outline of the seat-portion outer peripheral surface or similar member is parallel to the axis in the cross section including the axis, but also the case where the outline of the seat-portion outer peripheral surface or similar member is slightly inclined (for example, by an angle equal to or less than 10 degrees of an acute angle among the angles formed by the outline and the axis) with respect to the axis in the cross section including the axis.

Additionally, "the area SB of the tapering surface" is an area of a portion of the seat portion that contacts a receiving die supporting the metal shell in the caulking process and is pushed to, i.e., against, the receiving die when a load is applied to the rear end portion of the metal shell.

Configuration 2. In accordance with a second aspect of the present invention, there is provided a spark plug according to the configuration 1, wherein $5.0 \leq SC/LC \leq 10.0$ is satisfied.

From the view point of reducing the leakage of current flowing on the surface of the insulator between the center electrode and the metal shell, it is preferred to ensure a larger clearance formed between the portion (the insulator leg portion) positioned on the tip end side with respect to the lock portion in the insulator and the portion positioned on the tip end side with respect to the protrusion in the metal shell. From the view point of reducing the leakage of current, it is also preferred to ensure a larger distance between the tip end portion of the center electrode and the protrusion along the axial direction.

Configuration 3. In accordance with a third aspect of the present invention, there is provided a spark plug according to the configuration 1 or 2, wherein a distance LA from the rear end of the tapering surface to a rear end of the protrusion along the axis is equal to or more than 16 mm.

Configuration 4. In accordance with a fourth aspect of the present invention, there is provided a spark plug according to any one of the configuration 1 to 3, wherein $TD \geq 0.5$ and $TB/TD \geq 4.2$ are satisfied in a case where a wall thickness of the seat portion is TB (mm) at the rear end of the tapering surface, and a minimum wall thickness of the bulge portion is TD (mm).

Configuration 5. In accordance with a fifth aspect of the present invention, there is provided a spark plug according to any one of the configuration 1 to 4, wherein $1.1 \leq TE/TD \leq 1.3$ is satisfied in a case where a minimum wall thickness of the bulge portion is TD (mm), and a minimum wall thickness of the caulking portion is TE (mm).

According to the spark plug in the configuration 1, $SB/LB \leq 12.0$ is satisfied. That is, the sufficient length LB, which is equivalent (corresponds) to the strength of the seat portion, was ensured with respect to the area SB, which is equivalent (corresponds) to the force applied to the seat portion during the caulking process. This more surely restricts excessive deformation of the seat portion during the caulking process.

Additionally, according to the spark plug in the configuration 1, $SC/LC \leq 12.0$ is satisfied. That is, the sufficient length LC, which is equivalent (corresponds) to the strength of the protrusion was ensured with respect to the area SC, which is equivalent (corresponds) to the force applied to the protrusion during the caulking process. This more surely restricts excessive deformation of the protrusion during the caulking process.

As described above, the spark plug in the configuration 1 more surely restricts excessive deformation of the seat portion and the protrusion, and ensures a sufficiently large axial force applied from the metal shell to the insulator.

Additionally, according to the spark plug in the configuration 1, $SB/SC \geq 3.5$ is satisfied with the configuration that ensures a large axial force as described above. Here, a larger area SB causes a smaller pressure applied to the tapering surface in the caulking process. This restricts excessive collapse and deformation of the tapering surface (restricts the movement of the protrusion to the tip end side). Accordingly, the axial force becomes considerably large. On the other hand, a smaller area SB causes a larger pressure applied to the tapering surface in the caulking process. Therefore, the tapering surface is relatively easy to deform. Accordingly, the axial force is sufficiently large, but becomes slightly smaller compared with the case of the large area SB. That is, the area SB is equivalent to the size of the axial force applied from the metal shell to the insulator. According to the above-described configuration 1, $SB/SC \geq 3.5$ is satisfied. Therefore, a value obtained by dividing the axial force by the area SC, that is, a contact pressure between the locked surface and the lock portion becomes sufficiently large. This ensures good air tightness between the metal shell and the insulator.

According to the spark plug in the configuration 2, $5.0 \leq SC/LC$ is satisfied. Here, a larger area SC separates the portion (the insulator leg portion) positioned on the tip end side with respect to the lock portion in the insulator from the inner peripheral surface of the metal shell. This expands the clearance formed between the portion positioned on the tip end side with respect to the protrusion in the metal shell and the insulator (the insulator leg portion). Additionally, a smaller length LC causes a larger distance between the tip end portion of the center electrode and the protrusion along the axial direction. The above-described configuration 2 satisfies at least one of a relatively large area SC and a relatively small length LC. This ensures a sufficiently large resistance meter between the tip end portion of the center electrode and the metal shell, thus efficiently reducing current leakage.

Additionally, according to the spark plug in the configuration 2, $SC/LC \leq 10.0$ is satisfied. Here, the small area SC or the large length LC further decreases the volume of the clearance formed between the surface of the insulator (the insulator leg portion) and the inner peripheral surface of the metal shell. Therefore, this reduces the heat accumulated at the clearance by the combustion gas, thus reducing overheating of the insulator. According to the above-described configuration 2, $SC/LC \leq 10.0$ is satisfied. This sufficiently reduces the volume of the clearance and efficiently reduces the heat remaining at the clearance. As a result, this more surely restricts overheating of the insulator and ensures good heat resistance.

According to the spark plug in the configuration 3, a distance LA from the rear end of the tapering surface to the rear end of the protrusion is set equal to or more than 16 mm, along the axis. This ensures a relatively short portion (insulator leg portion) positioned on the tip end side with respect to the lock portion in the insulator. Accordingly, this reduces received heat amount of the insulator leg portion during operation of the internal combustion engine or similar apparatus, thus further improving the heat resistance.

On the other hand, in the case where the distance LA is equal to or more than 16 mm, the thread portion further undergoes thermal expansion under high temperature, and this is more prone to decrease the axial force applied from the metal shell to the insulator. That is, in the case where the distance LA is equal to or more than 16 mm, decrease in air tightness under high temperature is concerned more.

In this respect, adopting the spark plug in the configuration 1 ensures a sufficiently large contact pressure between the locked surface and the lock portion. This maintains good air tightness even in the case where the distance LA is set equal to or more than 16 mm and the thread portion further undergoes thermal expansion under high temperature. In other words, the above-described configuration 1 and similar configuration are especially effective in the spark plug that has difficulty in ensuring good air tightness under high temperature in the case where the distance LA is set equal to or more than 16 mm.

According to the spark plug in the configuration 4, TB/TD≥4.2 is satisfied to ensure a sufficiently small minimum wall thickness TD of the bulge portion with respect to the wall thickness TB of the seat portion. This more surely reduces deformation of the seat portion toward the outer peripheral side in the caulking process, thus more surely applying a load to the portion (a portion to be the bulge portion after deformation) equivalent to the bulge portion. This more surely causes buckling deformation of the bulge portion, thus further increasing the axial force applied from the metal shell to the insulator. As a result, the air tightness is further improved.

Additionally, according to the spark plug in the configuration 4, TD≥0.5 is satisfied to ensure good mechanical strength of the bulge portion. Therefore, this reduces the occurrence of damage, such as cracks, on the bulge portion when an impact is applied in association with the operation of the internal combustion engine. As a result, this more surely prevents decrease in air tightness in association with the damage on the bulge portion.

According to the spark plug in the configuration 5, 1.1≤TE/TD is satisfied. That is, the minimum wall thickness TE of the caulking portion is set sufficiently large with respect to the minimum wall thickness TD of the bulge portion corresponding to the size of the axial force. Therefore, the caulking portion has rigidity sufficiently resistant to the axial force. This more surely prevents deformation (springback deformation) of the caulking portion during application of the impact. This consequently maintains good air tightness during application of the impact.

Additionally, according to the spark plug in the configuration 5, TE/TD ≤1.3 is satisfied. This restricts an excessively large rigidity of the caulking portion with respect to the rigidity of the bulge portion. Therefore, this allows more surely deforming the portion (a portion to be the caulking portion after deformation) equivalent to the caulking portion without extreme increase in load during the caulking process, thus applying a sufficient load to the portion (a portion to be the bulge portion after deformation) equivalent to the bulge portion. This ensures a sufficient large amount of buckling deformation of the bulge portion, thus ensuring a larger axial force. As a result, the air tightness is further improved.

DETAILED DESCRIPTION OF THE PREFERRED EMBODIMENTS

Figure 1:
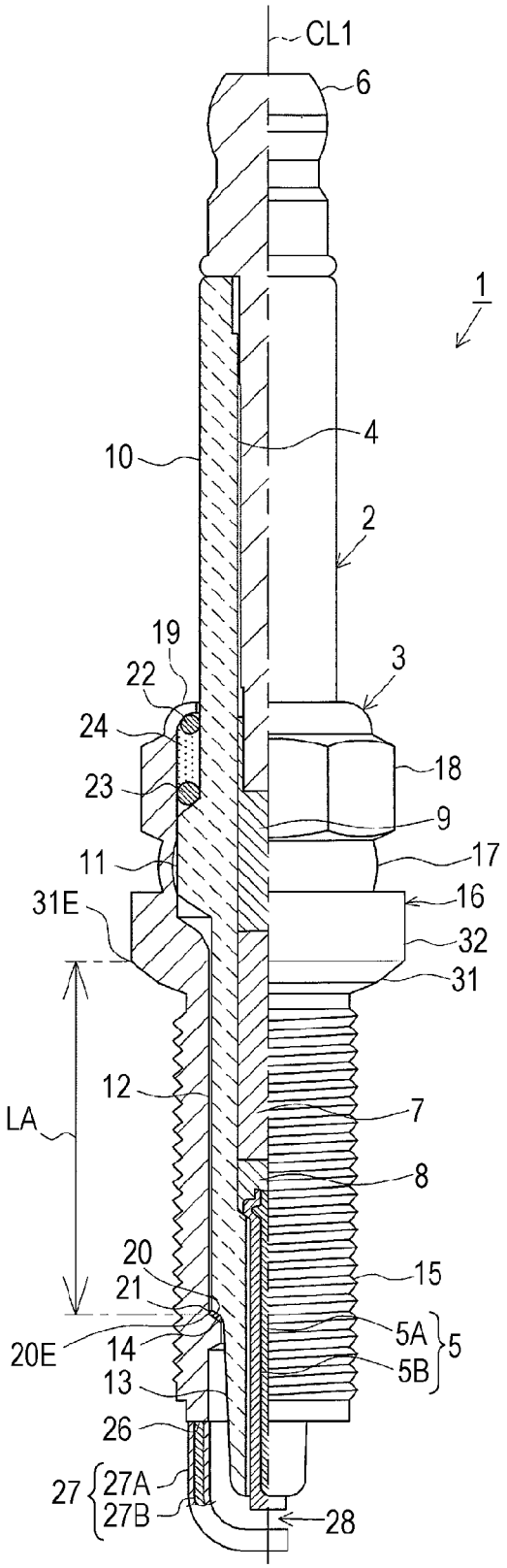
FIG. 1 is a partially sectioned front view showing a configuration of a spark plug.

Hereinafter, one embodiment will be described with reference to the drawings. FIG. 1 is a partially sectioned front view showing a spark plug 1. Note that in the description of FIG. 1, a description will be given of a direction in which an axis CL1 of the spark plug 1 is a vertical direction in the drawing. Moreover, the lower side is a tip end side of the spark plug 1, and the upper side is a rear end side.

The spark plug 1 includes a tubular insulating insulator 2 as an insulator, a tubular metal shell 3, which holds the insulating insulator 2, and similar member.

The insulating insulator 2 is formed from alumina or the like by sintering, as well known in the art. The insulating insulator 2 externally includes a rear end trunk portion 10 formed on the rear end side, a large-diameter portion 11, an intermediate trunk portion 12, and an insulator leg portion 13. The large-diameter portion 11 is located on the tip end side with respect to the rear end trunk portion 10 and formed to project radially outward. The intermediate trunk portion 12 is located on the tip end side with respect to the large-diameter portion 11 and is formed to be smaller in diameter than the large-diameter portion 11. The insulator leg portion 13 is located on the tip end side with respect to the intermediate trunk portion 12 and is formed to be smaller in diameter than the intermediate trunk portion 12. Additionally, the large-diameter portion 11, the intermediate trunk portion 12, and the greater portion of the insulator leg portion 13 of the insulating insulator 2 are accommodated within the metal shell 3. A tapered lock portion 14 is formed at a connection portion between the intermediate trunk portion 12 and the insulator leg portion 13. The lock portion 14 has an outside diameter that gradually decreases toward the tip end side in the axis CL1 direction. The insulating insulator 2 is locked on the metal shell 3 at the lock portion 14.

The insulating insulator 2 has an axial hole 4 that extends along the axis CL1 and penetrates therethrough. A center electrode 5 is inserted into a tip end side of the axial hole 4, and secured. The center electrode 5 includes an inner layer 5A formed of metal excellent in thermal conductivity (for example, copper, copper alloy, and pure nickel (Ni)) and an outer layer 5B formed of an alloy that contains Ni as a main constituent. The center electrode 5 has a rodlike shape (a columnar shape) as a whole. The tip end face of the center electrode 5 is formed flat and projects from the tip end of the insulating insulator 2.

Additionally, a terminal electrode 6 is fixedly inserted into the rear end side of the axial hole 4 and projects from the rear end of the insulating insulator 2.

Furthermore, a columnar resistor 7 is disposed within the axial hole 4 between the center electrode 5 and the terminal electrode 6. Both end portions of the resistor 7 are electrically connected to the center electrode 5 and the terminal electrode 6, respectively, via electrically conductive glass seal layers 8 and 9.

Additionally, the metal shell 3 is made of a low-carbon steel or a similar metal and formed into a tubular shape. The metal shell 3 includes a thread portion (a male thread portion) 15 on its outer peripheral surface. The thread portion 15 is used to threadably mount the spark plug 1 into the mounting hole of the combustion apparatus (for example, an internal combustion engine or a fuel cell reformer). Also, the metal shell 3 includes a flange seat portion 16 located on the rear end side with respect to the thread portion 15. The seat portion 16 projects radially outward. A tapering surface 31 is disposed at the outer peripheral surface of the tip end of the seat portion 16. The tapering surface 31 gradually decreases in outer diameter toward the tip end side, and at least partially contacts the seating portion of the combustion apparatus when the thread portion 15 is threadably mounted on the mounting hole of the combustion apparatus. On the rear end side with respect to the seat portion 16, a bulge portion 17 is formed relatively thin and projects toward the outer peripheral side. Furthermore, on the rear end side of the metal shell 3, a tool engagement portion 18 having a hexagonal cross section is disposed to engage a tool such as a wrench when the metal shell 3 is mounted in the combustion apparatus. Also, on the rear end portion of the metal shell 3, a caulking portion 19 is disposed to be bent radially inward. Note that in this embodiment, the thread size of the thread portion 15 is equal to or less than M12.

In the metal shell 3, a protrusion 20 is disposed at the inner periphery on the tip end side with respect to the seat portion 16 and projects toward the inner peripheral side. The insulating insulator 2 is inserted into the metal shell 3 from the rear end side toward the tip end side of the metal shell 3. In a state where the lock portion 14 is locked to the protrusion 20, caulking the rear end portion of the metal shell 3 radially inward, that is, forming the caulking portion 19, secures the insulating insulator 2 to the metal shell 3. In this respect, the insulating insulator 2 is secured to the metal shell 3 in a state held between the caulking portion 19 and the protrusion 20. An axial force is applied to the insulating insulator 2 from the metal shell 3 by the bulge portion 17 and similar member.

An annular sheet packing 21 is interposed between the lock portion 14 and the protrusion 20. The lock portion 14 is indirectly locked to the protrusion 20 via the sheet packing 21. Disposing the sheet packing 21 ensures air tightness in a combustion chamber, and prevents outward leakage of fuel gas which enters the clearance between the inner peripheral surface of the metal shell 3 and the insulator leg portion 13 of the insulating insulator 2, which is exposed to the inside of the combustion chamber.

Further, in order to further ensure sealing which is established by caulking, annular ring members 22 and 23 are interposed between the metal shell 3 and the insulating insulator 2 at the rear end side of the metal shell 3. Powder of talc 24 is filled up between the ring members 22 and 23. That is, the metal shell 3 holds the insulating insulator 2 via the sheet packing 21, the ring members 22 and 23, and the talc 24.

A ground electrode 27 is sealed to a tip end portion 26 of the metal shell 3. The ground electrode 27 is bent at an approximately central portion thereof. Accordingly, the side face at the tip end side of the ground electrode 27 faces a tip end face of the center electrode 5. The ground electrode 27 has a double layer structure that includes an outer layer 27A formed of Ni alloy and an inner layer 27B formed of metal excellent in thermal conductivity compared with the Ni alloy, for example, copper alloy or pure copper. A spark discharge gap 28 is formed between the tip end portion of the center electrode 5 and the tip end portion of the ground electrode 27. Sparks are discharged at the spark discharge gap 28 in the direction almost along the axis CL1.

Figure 2:
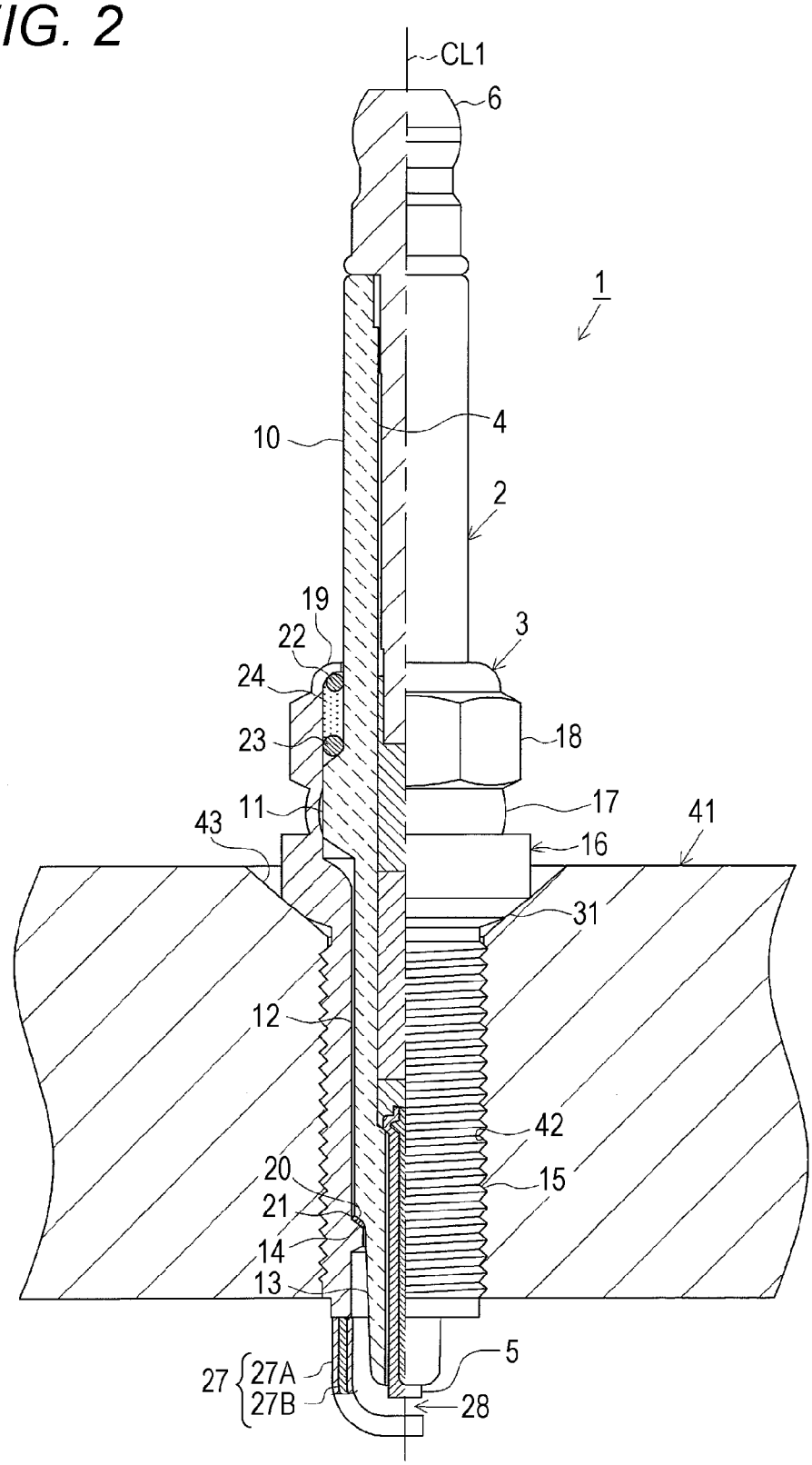
FIG. 2 is an enlarged partially sectioned front view showing the spark plug mounted on an internal combustion engine.

In this embodiment, as shown in FIG. 2, when the thread portion 15 is threadably mounted on a mounting hole 42 with a female thread, which is formed at an internal combustion engine 41 as the combustion apparatus, the tapering surface 31 comes into close contact with a seating portion 43 of the internal combustion engine 41 so as to ensure air tightness in the combustion chamber.

Figure 3:
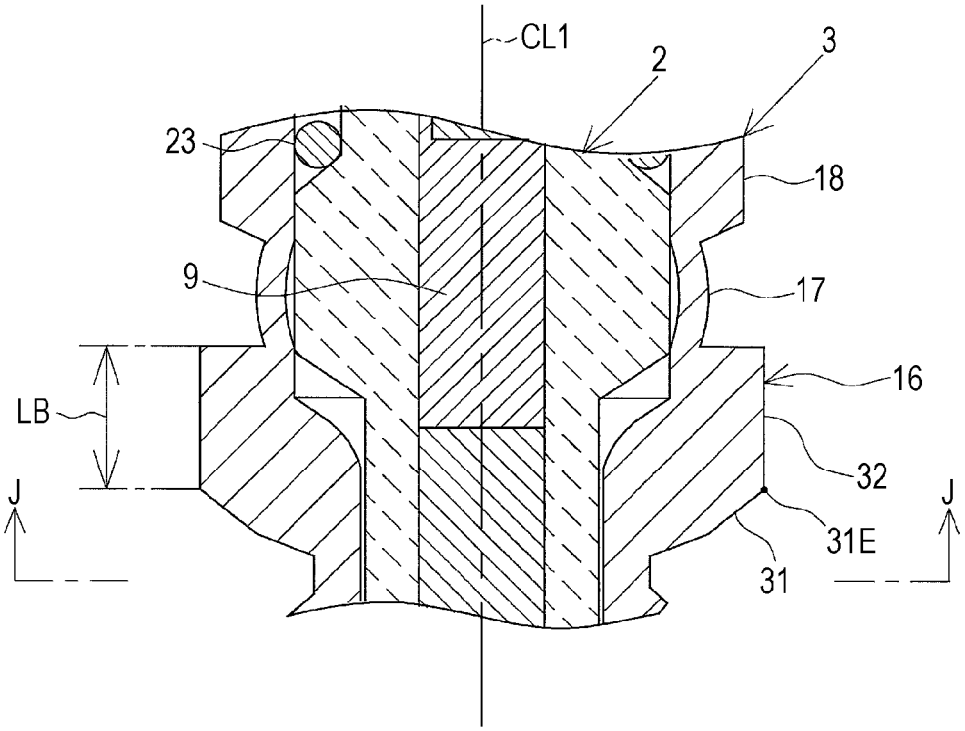
FIG. 3 is an enlarged sectional view showing a configuration of a seat portion and similar member.
Figure 4:
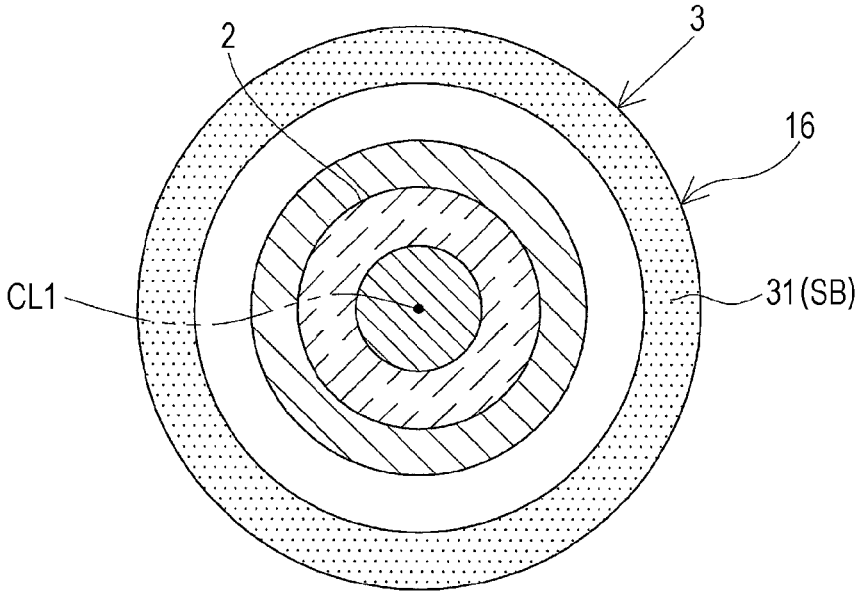
FIG. 4 is a sectional view taken along the line J-J of FIG. 3.

Additionally, as shown in FIG. 3, the seat portion 16 includes a seat-portion outer peripheral surface 32 as a surface extending from a rear end 31E of the tapering surface 31 to the rear end side in the axis CL1. The seat-portion outer peripheral surface 32 has a length of LB (mm) along the axis CL1. As shown in FIG. 4 (FIG. 4 is a sectional view taken along the line J-J of FIG. 3), an area (a part where a dot pattern is drawn in FIG. 4) of the tapering surface 31 is set to SB ($mm^2$). The length LB and the area SB satisfy $SB/LB \leq 12.0$ (mm).

In this embodiment, from the view point of ensuring the air tightness, the area SB is set equal to or more than a predetermined value (for example, 43 $mm^2$). Furthermore, on account of design constraints, the configuration does not have an excessively large length LB. As a result, in this embodiment, the configuration satisfies $5.0 \leq SB/LB$. Also, in this embodiment, an outline of the seat-portion outer peripheral surface 32 is parallel to the axis CL1 in a cross section including the axis CL1. However, the outline of the seat-portion outer peripheral surface 32 may be slightly inclined with respect to the axis CL1. Therefore, for example, in the cross section including the axis CL1, the outline of the seat-portion outer peripheral surface 32 may gradually separate from the axis CL1 toward the rear end side in the axis CL1 direction.

Figure 5:
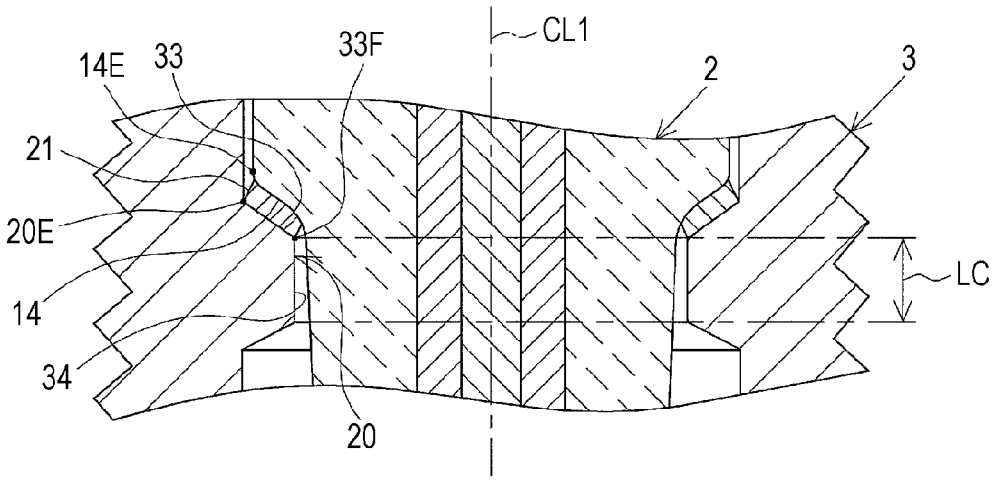
FIG. 5 is an enlarged sectional view showing a configuration of a protrusion and adjacent member.
Figure 6:
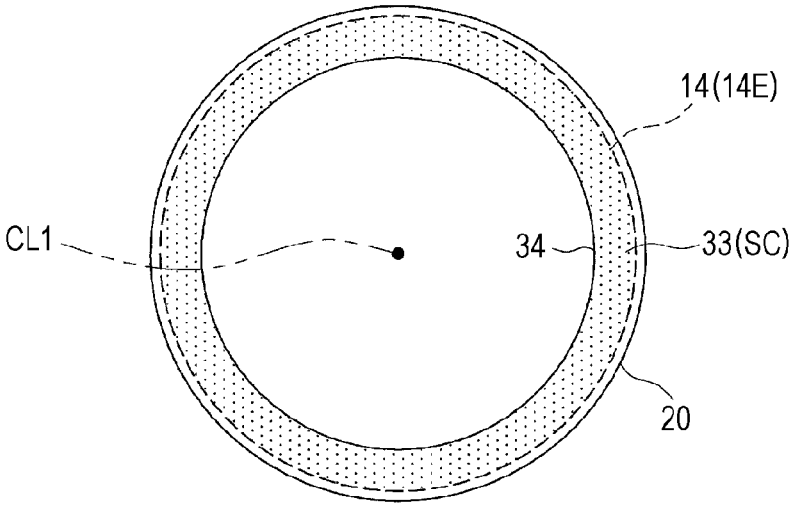
FIG. 6 is a projection view of a lock portion and the protrusion for explaining an area of a locked surface.

As shown in FIG. 5 and FIG. 6 (FIG. 6 is a projection view where the lock portion 14 and the protrusion 20 are projected along the axis CL1 onto a plane perpendicular to the axis CL1), the protrusion 20 includes a locked surface 33 (a part where a dot pattern is drawn in FIG. 6) and a protrusion inner peripheral surface 34. The locked surface 33 is a surface that is positioned at the inner peripheral side with respect to a rear end 14E of the lock portion 14 and is locked to the lock portion 14 via the sheet packing 21. The protrusion inner peripheral surface 34 is a surface extending from a tip end 33F of the locked surface 33 to the tip end side along the axis CL1. Assuming that the protrusion inner peripheral surface 34 has a length of LC (mm) along the axis CL1 while the locked surface 33 has an area of SC ($mm^2$). The configuration satisfies SC/LC≤12.0 (mm) (more preferably, satisfies 5.0≤SC/LC≤10.0).

In this embodiment, an outline of the protrusion inner peripheral surface 34 is parallel to the axis CL1 in the cross section including the axis CL1. However, the outline of the protrusion inner peripheral surface 34 may be slightly inclined with respect to the axis CL1. Therefore, for example, in the cross section including the axis CL1, the outline of the protrusion inner peripheral surface 34 may gradually come close to the axis CL1 toward the tip end side in the axis CL1 direction. In order to efficiently conduct heat of the insulating insulator 2 to the metal shell 3 side and improve heat conduction of the insulating insulator 2 and the center electrode 5, a distance along a direction perpendicular to the axis CL1 between the protrusion inner peripheral surface 34 and the outer peripheral surface of the insulating insulator 2 is set equal to or less than a predetermined value (for example, equal to or less than 0.5 mm). Furthermore, a distance along the direction perpendicular to the axis CL1 between the rear end 14E of the lock portion 14 and the inner peripheral surface of the metal shell 3 is set considerably low (for example, equal to or less than 0.2 mm).

In this embodiment, both the above-described areas SB and SC satisfy SB/SC≥3.5.

Additionally, in this embodiment, in order to prevent overheating of the insulator leg portion 13, a length of the insulator leg portion 13 along the axis CL1 is relatively small, in association with which a length from the tapering surface 31 to the protrusion 20 along the axis CL1 becomes relatively large. Specifically, as shown in FIG. 1, a distance LA from the rear end 31E of the tapering surface 31 to a rear end 20E of the protrusion 20 is set equal to or more than 16 mm, along the axis CL1.

Figure 7:
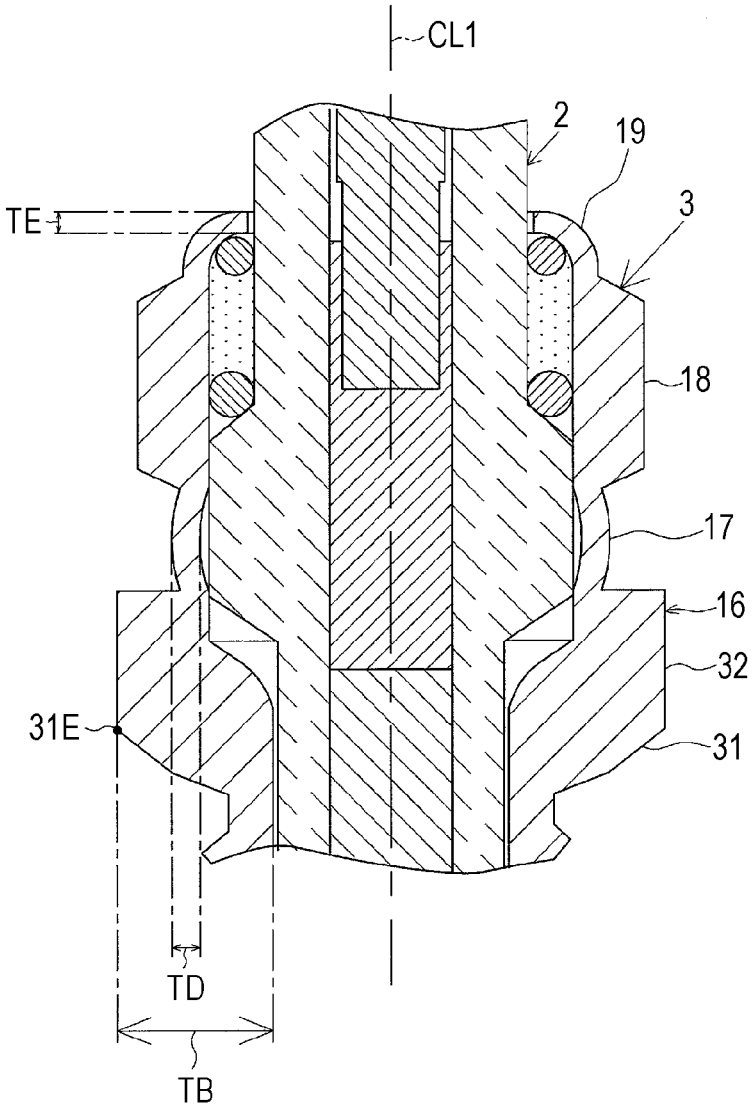
FIG. 7 is an enlarged sectional view showing a configuration of a bulge portion and a caulking portion.

As shown in FIG. 7, assume that the seat portion 16 has a wall thickness of TB (mm) along the direction perpendicular to the axis CL1 at the rear end 31E of the tapering surface 31, and the bulge portion 17 has the minimum wall thickness of TD (mm) along the direction perpendicular to the axis CL1. The configuration satisfies TD≥0.5 and TB/TD≥4.2.

Furthermore, assuming that the caulking portion 19 has the minimum wall thickness of TE (mm), the configuration satisfies 1.1≤TE/TD≤1.3.

Next, a method of manufacturing the spark plug 1 configured as described above will be described below.

First, the insulating insulator 2 is formed by a molding process. For example, base material granules for molding are prepared using raw material powder containing alumina as a predominant component, binder, and similar material. The base material granules are used for rubber press molding to obtain a cylindrical compact. Grinding work is performed on the obtained compact for trimming an outer shape of the compact. Subsequently, sintering work is performed on the trimmed compact to obtain the insulating insulator 2.

The center electrode 5 is manufactured separately from the insulating insulator 2. That is, the center electrode 5 is manufactured by forging work of Ni alloy that includes copper alloy and similar material at the center to improve heat radiation performance.

The insulating insulator 2 and the center electrode 5, which are obtained as described above, the resistor 7, and the terminal electrode 6 are secured together by sealing of the glass seal layers 8 and 9. To form the glass seal layers 8 and 9, generally, borosilicate glass and metal powder are mixed together. The prepared mixture is filled into the axial hole 4 of the insulating insulator 2 to sandwich the resistor 7, and then sintered by heating within a sintering furnace while being pressed from the rear side by the terminal electrode 6. At this time, a glaze layer may be simultaneously sintered on the surface of the rear end trunk portion 10 of the insulating insulator 2. Alternatively, the glaze layer may be formed in advance.

Subsequently, the metal shell 3 is formed. That is, a cold forging process or similar process is performed on a columnar metal material (a steel material such as S17C and S25C or a stainless steel material) to form a through hole and a rough shape. Subsequently, the outer shape is trimmed by cutting work to obtain an intermediate of the metal shell.

Subsequently, the straight-rod-shaped ground electrode 27 made of Ni alloy and similar material is welded by resistance welding to the tip end face of the intermediate of the metal shell. In this welding, what is called "sagging" occurs. Therefore, after the "sagging" is removed, the thread portion 15 is formed in a predetermined portion of the intermediate of the metal shell by rolling. Accordingly, the metal shell 3 with the sealed ground electrode 27 is obtained. At this phase, a portion equivalent to the rear end portion (the caulking portion 19) of the metal shell 3 has a cylindrical shape extending in the axis CL1 direction. Furthermore, a portion (a portion equivalent to the bulge portion 17) positioned between the seat portion 16 and the tool engagement portion 18 in the metal shell 3 has a cylindrical shape without projection toward the outer peripheral side.

Subsequently, in the caulking process, the insulating insulator 2 including the center electrode 5 and the terminal electrode 6, which are each manufactured as described above, is secured to the metal shell 3 with the ground electrode 27.

Figure 8:
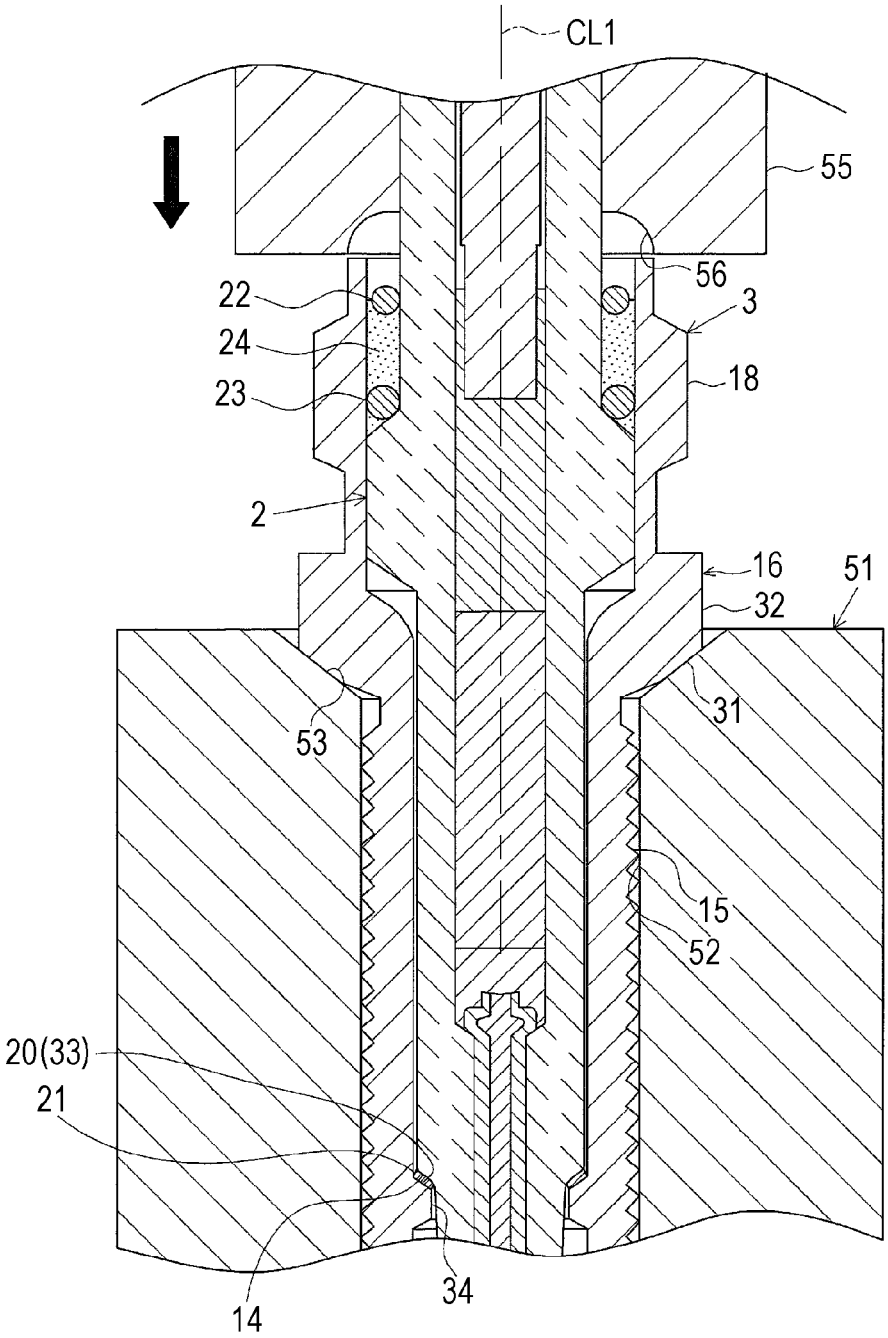
FIG. 8 is an enlarged sectional view showing a step of a caulking process.

In the caulking process, as shown in FIG. 8, the tip end portion of the metal shell 3 is first inserted into a tubular receiving die 51 in a state where the insulating insulator 2 is inserted into the metal shell 3. Accordingly, the metal shell 3 is held by the receiving die 51.

The receiving die 51 includes an insertion hole 52 and an annular receiving surface 53. The insertion hole 52 allows insertion of the thread portion 15. The receiving surface 53 connects to an opening of the insertion hole 52 and is in contact with the tapering surface 31. The receiving surface 53 is set to have the same slanted angle as the slanted angle of the tapering surface 31 so that the entire region of the tapering surface 31 contacts the receiving surface 53. The receiving die 51 is formed of hard steel such as hardened steel. At least, the hardness of the receiving surface 53 is set larger than the hardness of the tapering surface 31.

Subsequently, the ring members 22 and 23 are disposed between the rear end portion of the metal shell 3 and the insulating insulator 2 to sandwich the talc 24.

Figure 9:
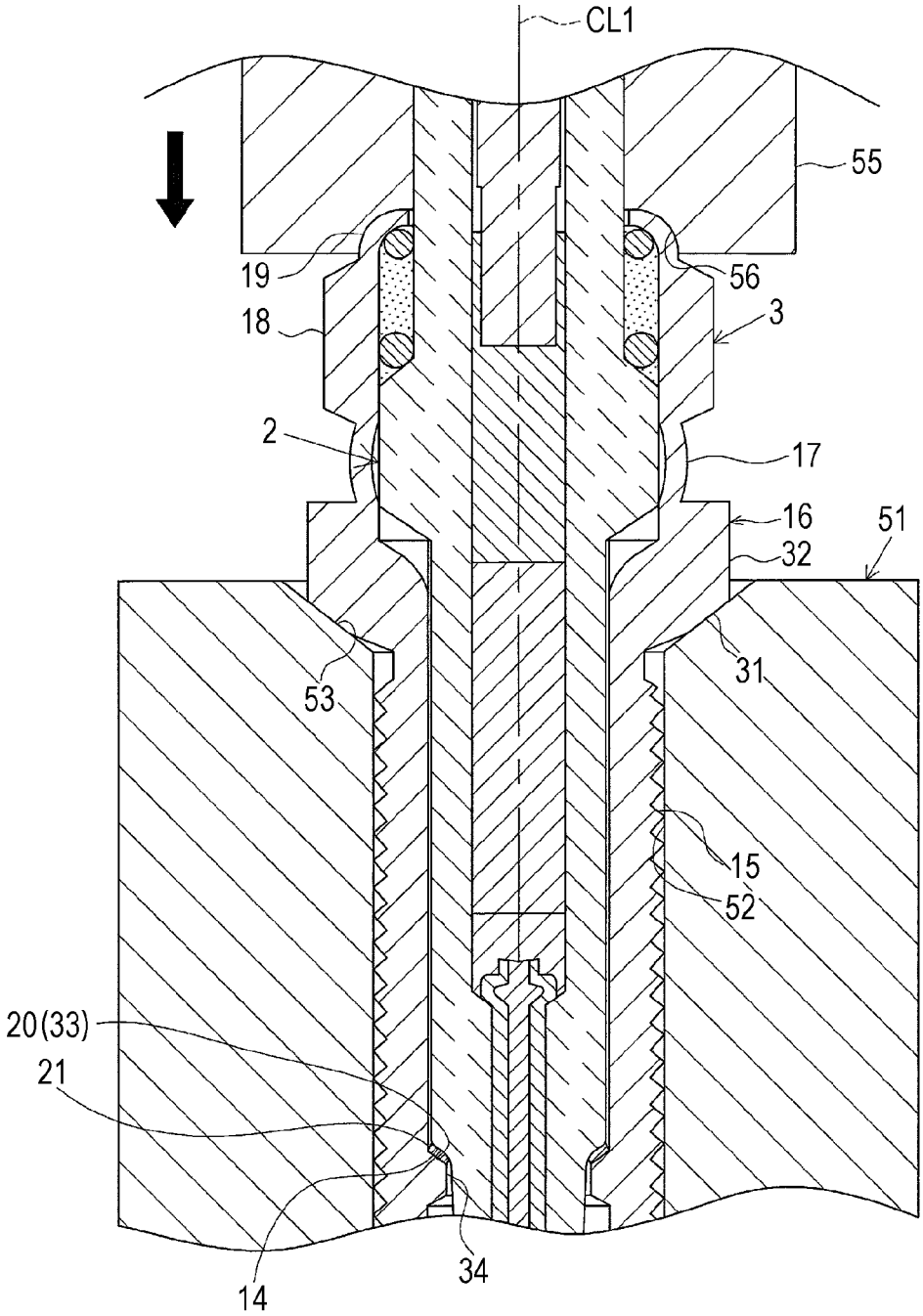
FIG. 9 is an enlarged sectional view showing a step of the caulking process.

After the ring members 22 and 23 and the talc 24 are disposed, a tubular pressing die 55 is installed from the upper side of the metal shell 3. The pressing die 55 includes a curved surface portion 56 on an inner peripheral surface at a tip end of an opening portion. The curved surface portion 56 has a shape corresponding to the shape of the caulking portion 19. Additionally, as shown in FIG. 9, a predetermined load (for example, equal to or more than 34 kN and equal to or less than 42 kN) is applied to the rear end portion of the metal shell 3 toward the receiving die 51 side by the pressing die 55 in a state where the metal shell 3 is sandwiched between the receiving die 51 and the pressing die 55. This bends the rear end portion of the metal shell 3 radially inward so as to form the caulking portion 19. Additionally, this causes buckling deformation of a portion positioned between the seat portion 16 and the tool engagement portion 18 in the metal shell 3 toward the outer peripheral side so as to form the bulge portion 17. As a result, an axial force along the axis CL1 is applied from the metal shell 3 to the portion positioned between the caulking portion 19 and the protrusion 20 in the insulating insulator 2. The insulating insulator 2 and the metal shell 3 are secured together in a state of high contact pressure between the locked surface 33 and the lock portion 14 (the sheet packing 21). Note that the above-described area SB of the tapering surface 31 is an area of a portion of the seat portion 16 that contacts the receiving die 51 (the receiving surface 53) and is pressed to the receiving die 51 (the receiving surface 53) during the caulking process.

After the metal shell 3 and the insulating insulator 2 are secured together, the ground electrode 27 is bent toward the center electrode 5 side. Also, the size of the spark discharge gap 28, which is formed between the tip end portion of the center electrode 5 and the tip end portion of the ground electrode 27, is adjusted. Thus, the above-described spark plug 1 is obtained.

As described above in detail, according to this embodiment, the configuration satisfies SB/LB≤12.0 and SC/LC≤12.0. This more surely restricts excessive deformation of the seat portion 16 and the protrusion 20 during the caulking process. As a result, this ensures a sufficiently large axial force applied from the metal shell 3 to the insulating insulator 2.

Furthermore, in this embodiment, SB/SC≥3.5 is satisfied. This ensures a sufficiently large contact pressure between the locked surface 33 and the lock portion 14. This consequently ensures good air tightness between the metal shell 3 and the insulating insulator 2.

Especially, the spark plug 1 in this embodiment has the distance LA equal to or more than 16 mm. The thread portion 15 is more prone to undergo thermal expansion. Therefore, it is difficult to ensure good air tightness under high temperature. However, satisfying SB/SC≥3.5, SB/LB≤12.0, and SC/LC≤12.0 allows maintaining good air tightness under high temperature. That is, the above-described configuration is especially effective in the spark plug 1 where the distance LA is equal to or more than 16 mm like this embodiment.

Additionally, in this embodiment, 5.0≤SC/LC is satisfied. Therefore, the configuration satisfies at least one of a relatively large area SC and a relatively small length LC. This ensures a sufficiently large resistance meter between the tip end portion of the center electrode 5 and the metal shell 3, thus efficiently reducing current leakage.

Additionally, SC/LC≤10.0 is satisfied. Therefore, this ensures a sufficiently small volume of the clearance formed between the external surface of the insulator leg portion 13 and the inner peripheral surface of the metal shell 3. Accordingly, this efficiently reduces heat remaining in the clearance, thus more surely reducing overheating of the insulating insulator 2. As a result, good heat resistance is obtained.

Furthermore, in this embodiment, the configuration satisfies TB/TD≥4.2 to ensure a sufficiently small minimum wall thickness TD of the bulge portion 17 with respect to the wall thickness TB of the seat portion 16. Accordingly, in the caulking process, this more surely reduces the deformation of the seat portion 16, and more surely causes the buckling deformation of the bulge portion 17. As a result, this further increases the axial force applied from the metal shell 3 to the insulating insulator 2, thus further improving the air tightness.

Additionally, TD≥0.5 is satisfied so that the bulge portion 17 is constituted to have good mechanical strength. Accordingly, this reduces occurrence of damage such as crack in the bulge portion 17 during application of the impact. As a result, this more surely prevents decrease in air tightness in association with the damage of the bulge portion 17.

Additionally, the configuration satisfies 1.1≤TE/TD. This more surely prevents deformation (springback deformation) of the caulking portion 19 during application of the impact. This consequently maintains good air tightness during application of the impact.

Furthermore, the configuration satisfies TE/TD≤1.3. This restricts excessively large rigidity of the caulking portion 19 with respect to the rigidity of the bulge portion 17. Therefore, this allows more surely deforming the portion equivalent to the caulking portion 19 without extreme increase in load during the caulking process, thus applying a sufficient load to the portion equivalent to the bulge portion 17. This ensures a sufficient large amount of buckling deformation of the bulge portion 17, thus ensuring a larger axial force applied from the metal shell 3 to the insulating insulator 2. As a result, the air tightness is further improved.

Next, in order to confirm the actions and effect achieved by the above-described embodiments, an air tightness evaluation test and a deformation-resistance evaluation test were carried out for each sample. The metal shell and the insulating insulator were secured together through the caulking process described above. The thread size of the thread portion is set to M12 or M10, and the respective areas SB and SC ($mm^2$) and the respective lengths LB and LC (mm) were varied so as to manufacture samples of the spark plugs where SB/SC, SB/LB (mm), and SC/LC (mm) were varied.

The overview of the air tightness evaluation test is as follows. The sample was attached to a test bench, which is made of aluminum and simulates the above-described internal combustion engine, and the seating portion of the test bench was heated at 200° C. In this state, an air pressure of 1.5 MPa was applied to the tip end of the sample. It was checked whether or not the air leaked from between the metal shell and the insulating insulator. Here, the sample without observation of air leakage was evaluated as "o" with good air tightness. On the other hand, the sample with observation of air leakage was evaluated as "x" with insufficient air tightness. Table 1 shows the test result of this test on the sample with M12. Table 2 shows the test result of this test on the sample with M10.

Figure 10:
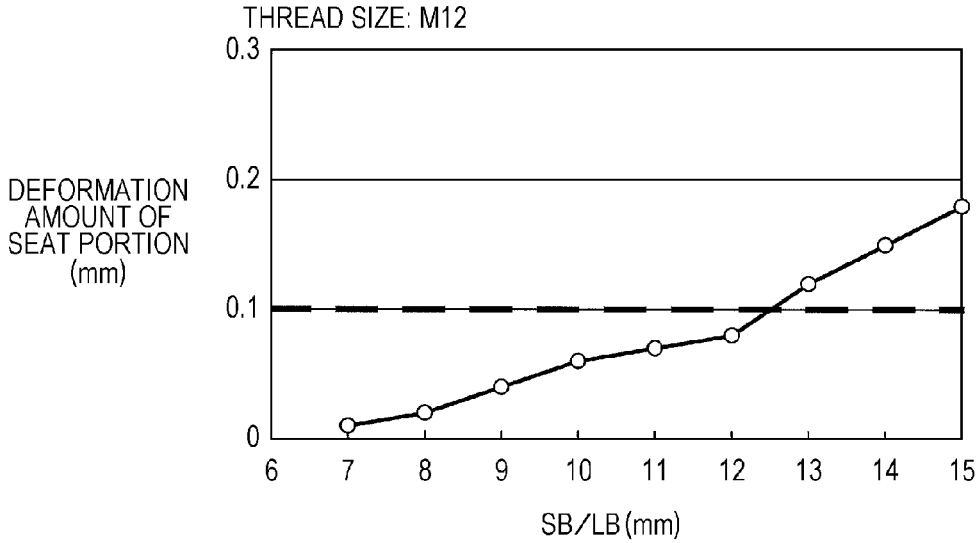
FIG. 10 is a graph showing a relationship between SB/LB and a deformation amount of a seat portion in a sample with a thread size of M12.
Figure 11:
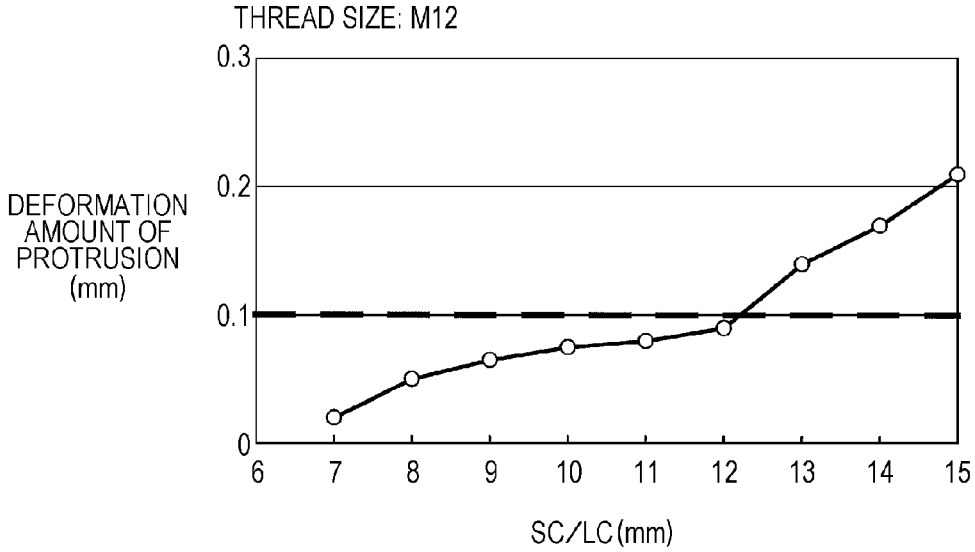
FIG. 11 is a graph showing a relationship between SC/LC and a deformation amount of a protrusion in the sample with the thread size of M12.
Figure 12:
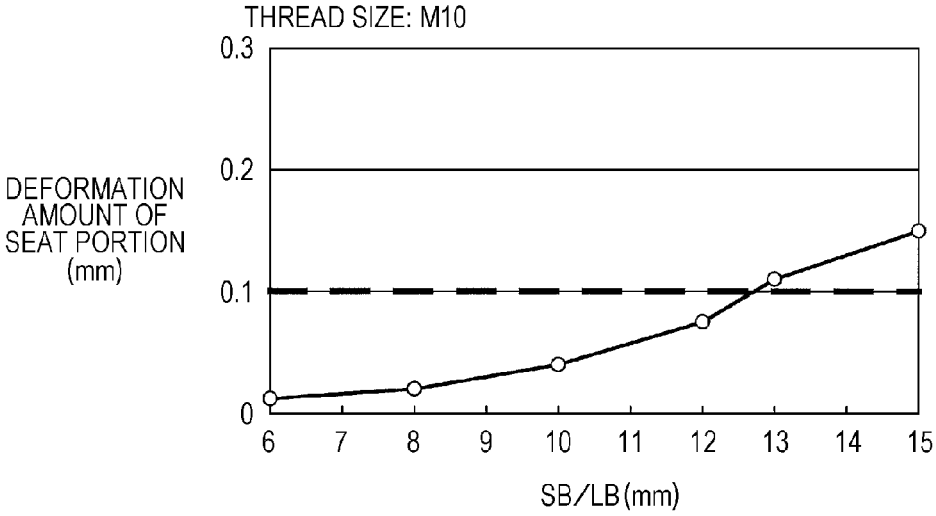
FIG. 12 is a graph showing a relationship between SB/LB and a deformation amount of a seat portion in a sample with a thread size of M10.
Figure 13:
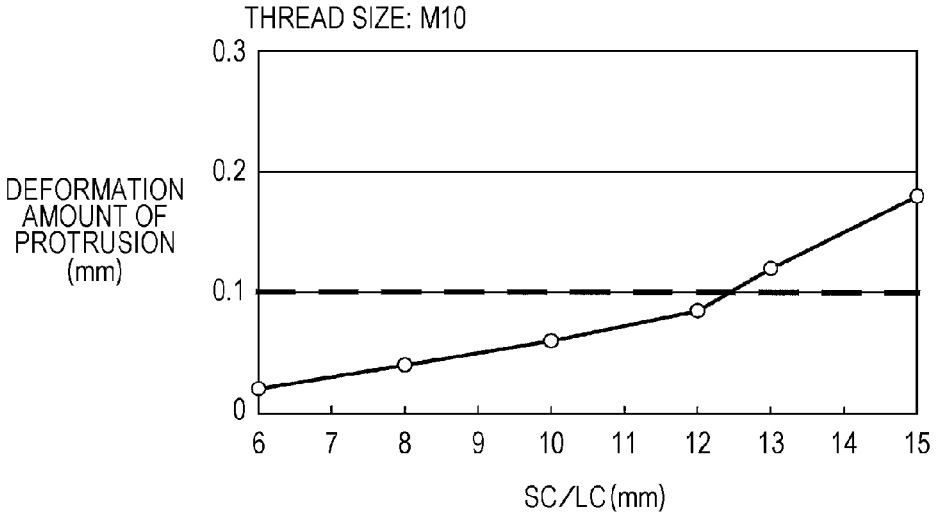
FIG. 13 is a graph showing a relationship between SC/LC and a deformation amount of a protrusion in the sample with the thread size of M10.

The overview of the deformation-resistance evaluation test is as follows. That is, the seat portion and the protrusion of the sample were observed to measure a deformation amount of the seat portion along the axial direction by the caulking process and a deformation amount of the protrusion along the axial direction by the caulking process. The deformation amount equal to or less than 0.1 mm allows applying a sufficient axial force from the metal shell to the insulating insulator. This is preferred from the view point of ensuring good air tightness. FIG. 10 is a graph showing a relationship between SB/LB and the deformation amount of the seat portion in the sample with the thread size of M12. FIG. 11 is a graph showing a relationship between SC/LC and the deformation amount of the protrusion in the sample with the thread size of M12. FIG. 12 is a graph showing a relationship between SB/LB and the deformation amount of the seat portion in the sample with the thread size of M10. FIG. 13 is a graph showing a relationship between SC/LC and the deformation amount of the protrusion in the sample with the thread size of M10.

TABLE 1

| Thread size: M12 | | | |
|---|---|---|---|
| Area of tapering surface SB($mm^2$) | Area of locked surface SC($mm^2$) | SB/SC | Air tightness evaluation |
| 43 | 15 | 2.9 | x |
| 43 | 13 | 3.3 | x |
| 43 | 11 | 3.9 | ○ |
| 41 | 13 | 3.2 | x |
| 45 | 13 | 3.5 | ○ |
| 51 | 13 | 3.9 | ○ |
| 55 | 13 | 4.2 | ○ |
| 51 | 18 | 2.8 | x |
| 51 | 15 | 3.4 | x |
| 51 | 13 | 3.9 | ○ |
| 51 | 11 | 4.6 | ○ |

TABLE 2

| Thread size: M10 | | | |
|---|---|---|---|
| Area of tapering surface SB($mm^2$) | Area of locked surface SC($mm^2$) | SB/SC | Air tightness evaluation |
| 43 | 13 | 3.3 | x |
| 43 | 11 | 3.9 | ○ |
| 43 | 9 | 4.8 | ○ |
| 43 | 7 | 6.1 | ○ |
| 44 | 13 | 3.4 | x |
| 45 | 13 | 3.5 | ○ |
| 47 | 13 | 3.6 | ○ |
| 49 | 13 | 3.8 | ○ |
| 53 | 16 | 3.3 | x |
| 53 | 12 | 4.4 | ○ |
| 53 | 8 | 6.6 | ○ |

As shown in Table 1 and Table 2, it has been demonstrated that the sample satisfying SB/SC≥3.5 has good air tightness. It is considered that this is because the divided value of the axial force by the area SC, that is, the contact pressure between the locked surface and the lock portion becomes sufficiently large by satisfying SB/SC≥3.5. Here, the area SB is equivalent to difficulty in deformation of the tapering surface during the caulking process, that is, the size of the axial force applied from the lock portion to the locked surface (protrusion).

As shown in FIG. 10 and FIG. 12, the sample satisfying SB/LB≤12.0 was found to restrict the excessive deformation of the seat portion. It is considered that this is because the sufficient length LB equivalent to the strength of the seat portion was ensured with respect to the area SB equivalent to the force applied to the seat portion during the caulking process.

Further, as shown in FIG. 11 and FIG. 13, the sample satisfying SC/LC≤12.0 was confirmed to restrict the excessive deformation of the protrusion. It is considered that this is because the sufficient length LC equivalent to the strength of the protrusion was ensured with respect to the area SC equivalent to the force applied to the protrusion during the caulking process.

According to the above-described test results, the preferred configuration satisfies SB/SC≥3.5, SB/LB≤12.0, and SC/LC≤12.0 to restrict the excessive deformation of the seat portion and the protrusion and ensure good air tightness between the metal shell and the insulating insulator.

Next, samples of the spark plugs with varied SC/LC (mm) were manufactured by varying the area SC ($mm^2$) and the length LC (mm). An anti-leakage property evaluation test and a heat resistance evaluation test were carried out for each sample.

The overview of the anti-leakage property evaluation test is as follows. That is, the sample was attached to a predetermined chamber, and the pressure within the chamber was set to 1.5 MPa. Then, a predetermined voltage was applied to the center electrode 100 times. The number of occurrences of leakage of current flowing on the surface of the insulating insulator between the center electrode and the metal shell was measured to calculate the incidence of leakage within 100 times. Here, the sample with the incidence of leakage equal to or less than 10% was not likely to have the leakage of current (that is, more surely generated normal spark discharge at the spark discharge gap), and thus was evaluated as "o" with good ignitability. On the other hand, the sample with a higher incidence of leakage than 10% was likely to have the leakage of current, and thus was evaluated as "x" with low ignitability.

The overview of the heat resistance evaluation test is as follows. That is, the sample was attached to a predetermined engine, and then the engine was driven by a predetermined number of cycles under a condition where the tip end portion of the center electrode became 900° C. Subsequently, the number of occurrences of pre-ignition was measured. Here, the sample where the number of occurrences of pre-ignition was equal to or less than four was likely to draw heat of the insulating insulator and the center electrode, and thus was evaluated as "o" with excellent heat resistance. On the other hand, the sample where the number of occurrences of pre-ignition was more than four has difficulty in drawing heat of the insulating insulator and the center electrode, and thus was evaluated as "x" with low heat resistance.

Table 3 shows the test result of the anti-leakage property evaluation test and the test result of the heat resistance evaluation test. In all the samples, the thread size of the thread portion was set to M12 and SB/SC was set to 3.5. In the samples used in the anti-leakage property evaluation test, the size of the spark discharge gap was set to 0.9 mm.

TABLE 3

| Area of locked surface SC($mm^2$) | Length of protrusion inner peripheral surface LC(mm) | SC/LC (mm) | Anti-leakage property evaluation | Heat resistance evaluation |
|---|---|---|---|---|
| 13 | 1 | 13.0 | ○ | x |
| 13 | 1.2 | 10.8 | ○ | x |
| 13 | 1.4 | 9.3 | ○ | ○ |
| 13 | 1.8 | 7.2 | ○ | ○ |
| 13 | 2 | 6.5 | ○ | ○ |
| 13 | 2.2 | 5.9 | ○ | ○ |
| 13 | 2.4 | 5.4 | ○ | ○ |
| 13 | 2.6 | 5.0 | ○ | ○ |
| 13 | 2.8 | 4.6 | x | ○ |
| 13 | 3 | 4.3 | x | ○ |
| 6 | 1.5 | 4.0 | x | ○ |
| 8 | 1.5 | 5.3 | ○ | ○ |
| 10 | 1.5 | 6.7 | ○ | ○ |
| 12 | 1.5 | 8.0 | ○ | ○ |
| 14 | 1.5 | 9.3 | ○ | ○ |
| 15 | 1.5 | 10.0 | ○ | ○ |
| 16 | 1.5 | 10.7 | ○ | x |
| 18 | 1.5 | 12.0 | ○ | x |

As shown in Table 3, it has been demonstrated that the sample satisfying 5.0≤SC/LC is excellent in anti-leakage property. This is thought to be for the following reasons. That is, the larger area SC consequently separates the insulator leg portion from the inner peripheral surface of the metal shell, thus ensuring a large clearance formed between: the inner peripheral surface of the portion positioned on the tip end side with respect to the protrusion in the metal shell; and the outer peripheral surface of the insulating insulator. This restricts occurrence of the leakage of current. Additionally, the smaller length LC ensures a larger distance between the tip end portion of the center electrode and the protrusion along the axial direction. This restricts occurrence of the leakage of current. Here, setting 5.0≤SC/LC satisfies at least one of a relatively large area SC and a relatively small length LC. As a result, the excellent anti-leakage property was considered to be achieved.

Also, it has been found that sample satisfying SC/LC≤10.0 is excellent in heat resistance. It is considered that this is because of the following reason. That is, the small area SC or the large length LC further decreases the volume of the clearance formed between the surface of the insulator leg portion and the inner peripheral surface of the metal shell. Therefore, this reduces the heat accumulated at the clearance by the combustion gas, thus reducing overheating of the insulating insulator. Accordingly, setting to SC/LC≤10.0 restricted overheating of the insulating insulator by the combustion gas. As a result, good heat resistance was considered to be obtained.

According to the above-described test results, it is preferred that 5.0 ≤SC/LC≤10.0 be satisfied so as to achieve excellent in both anti-leakage property and heat resistance.

Figure 14:
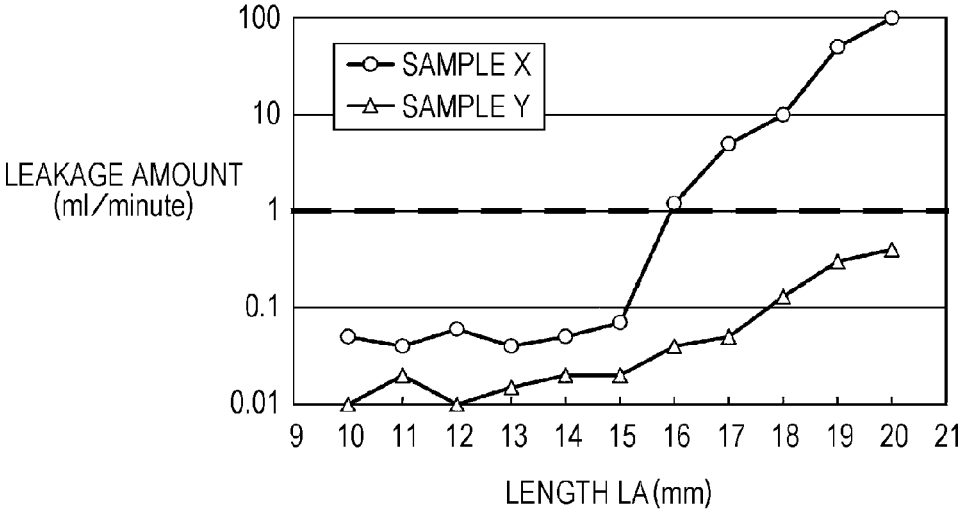
FIG. 14 is a graph showing air leakage amounts when each length LA is varied in a sample X with SB/SC of 2.9 mm and a sample Y with SB/SC of 3.5 mm.

Next, samples X of the spark plug (equivalent to a comparative example) with varied lengths LA (mm) and SB/SC of 2.9 were manufactured, and samples Y of the spark plug (equivalent to the embodiment) with varied lengths LA (mm) and SB/SC of 3.5 were manufactured. The heating temperature of the seating portion of the test bench was changed from 200° C. to 225° C. (that is, under more severe conditions), and then the air tightness evaluation test was carried out. In this test, the sample that had air leakage amount equal to or less than 1 ml/minute from between the metal shell and the insulating insulator was evaluated to have excellent air tightness. FIG. 14 shows the test result of this test. In FIG. 14, a circle mark denotes the test result of the sample X and a triangle mark denotes the test result of the sample Y. Both the samples were set to have the thread size of M12 in the thread portion and satisfy SB/LB≤12.0 and SC/LC≤12.0.

As shown in FIG. 14, the sample X equivalent to the comparative example had the air leakage amount exceeding 1 ml/minute in case of the length LA equal to or more than 16 mm. On the other hand, the sample Y equivalent to the embodiment had the air leakage amount equal to or less than 1 ml/minute even in case of the length LA equal to or more than 16 mm. This test demonstrated that the excellent air tightness was maintained.

According to the above-described test results, it is especially effective to satisfy SB/SC≥3.5, SB/LB≤12.0, and SC/LC≤12.0 in the case where the length LA is equal to or more than 16 mm and it is considerably difficult to ensure good air tightness.

Next, samples of the spark plug with varied wall thicknesses TB (mm) of the seat portion at the rear end of the tapering surface and varied minimum wall thicknesses TD (mm) of the bulge portion were manufactured. For each sample, the air tightness evaluation test where the heating temperature of the seating portion of the test bench was changed from 200° C. to 250° C., an impact resistance evaluation test compliant to Japanese Industrial Standard B8031, and a seat-portion projection amount evaluation test were carried out.

In the air tightness evaluation test, the sample where the air leakage amount from between the metal shell and the insulating insulator was equal to or less than 1 ml/minute was evaluated as "o" with so excellent air tightness. The sample where the air leakage amount is exceeding than 1 ml/minute was evaluated as "Δ" with slightly inferior air tightness.

The overview of the impact resistance evaluation test is as follows. That is, 10 samples with the same minimum wall thickness TD of the bulge portion and the same similar parameter were prepared. An impact was applied to each sample with a stroke of 22 mm for one hour at a rate of 400 times per minute. Subsequently, the samples were observed after one hour to check whether or not crack occurs in the bulge portion, and the number of samples with occurrences of crack out of 10 samples was measured. Here, the samples where the number of the occurrence of crack was equal to or less than five were evaluated as "o" with sufficient mechanical strength of the bulge portion. On the other hand, the samples where the number of the occurrence of crack was equal to or more than six were evaluated as "x" with insufficient mechanical strength of the bulge portion.

Furthermore, the overview of the seat-portion projection amount evaluation test is as follows. That is, the projection amount (a value obtained by subtracting the outer diameter of the seat portion before the caulking process from the outer diameter of the seat portion after the caulking process) of the seat portion toward the outer peripheral side was measured after the caulking process. The sample with the projection amount equal to or less than 0.1 mm in the seat portion was evaluated to provide a sufficiently large axial force applied from the metal shell to the insulating insulator and ensure excellent air tightness. This is because a smaller projection amount of the seat portion allows more surely applying a load to the portion equivalent to the bulge portion in the caulking process, thus more surely causing buckling deformation of the portion.

Figure 15:
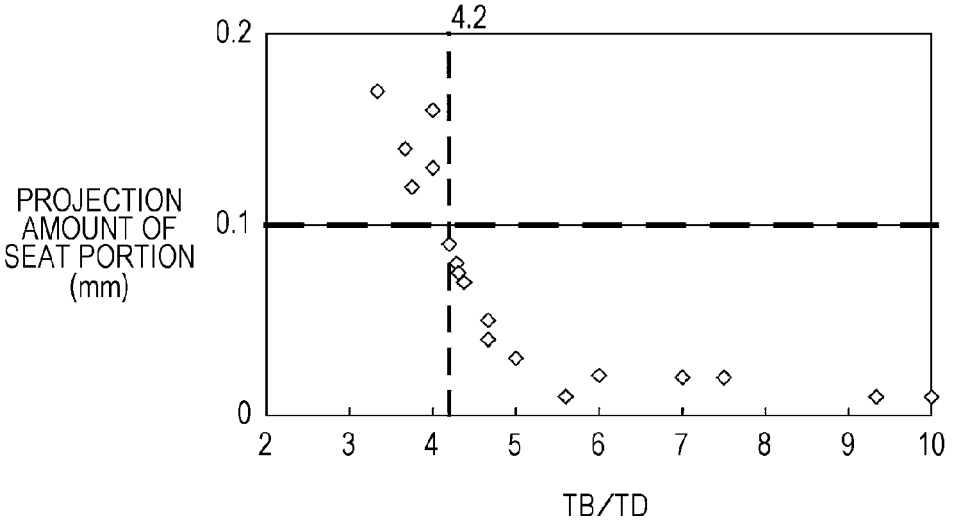
FIG. 15 is a graph showing a relationship between TB/TD and a deformation amount of the seat portion.

Table 4 shows the test result of the air tightness evaluation test and the test result of the impact resistance evaluation test. FIG. 15 shows the test result of the seat-portion projection amount evaluation test. Each sample was set to have the thread size of M12 in the thread portion, SB/SC of 3.5, SB/LB of 10, SC/LC of 10, and the length LA of 18 mm.

TABLE 4

| Wall thicknesses of seat portion TB(mm) | Minimum wall thicknesses of bulge portion TD(mm) | TB/TD | Air tightness evaluation | Impact resistance evaluation |
|---|---|---|---|---|
| 3 | 0.3 | 10.0 | ○ | x |
| 3 | 0.4 | 7.5 | ○ | x |
| 3 | 0.5 | 6.0 | ○ | ○ |
| 3 | 0.6 | 5.0 | ○ | ○ |
| 3 | 0.7 | 4.3 | ○ | ○ |
| 3 | 0.8 | 3.8 | Δ | ○ |
| 3 | 0.9 | 3.3 | Δ | ○ |
| 3.2 | 0.8 | 4.0 | Δ | ○ |
| 3.5 | 0.8 | 4.4 | ○ | ○ |
| 2.8 | 0.6 | 4.7 | ○ | ○ |
| 2.5 | 0.6 | 4.2 | ○ | ○ |
| 2.2 | 0.6 | 3.7 | Δ | ○ |
| 2.8 | 0.6 | 4.7 | ○ | ○ |
| 2.8 | 0.65 | 4.3 | ○ | ○ |
| 2.8 | 0.7 | 4.0 | Δ | ○ |
| 2.8 | 0.5 | 5.6 | ○ | ○ |
| 2.8 | 0.4 | 7.0 | ○ | x |
| 2.8 | 0.3 | 9.3 | ○ | x |

As shown in Table 4 and FIG. 15, it was confirmed that the sample satisfying TB/TD≥4.2 restricted the deformation of the seat portion toward the outer peripheral side and had so excellent air tightness. It is considered that this is because restricting the deformation of the seat portion toward the outer peripheral side allows more surely causing the buckling deformation of the bulge portion, consequently further increasing the axial force applied from the metal shell to the insulating insulator.

It is found that the sample satisfying TD≥0.5 more surely reduces damage on the bulge portion during application of the impact. It is considered that this is because the good mechanical strength was ensured in the bulge portion.

According to the above-described test results, it is preferred to satisfy TD≥0.5 and TB/TD≥4.2 from the view point of ensuring the sufficient mechanical strength in the bulge portion and restrict deformation of the seat portion toward the outer peripheral side during the caulking process so as to realize further excellent air tightness.

Next, samples of the spark plug were manufactured with varied TE/TD by changing the minimum wall thickness TE (mm) of the caulking portion in a state where the minimum wall thickness TD of the bulge portion was set to 0.5 mm or 0.8 mm. For each sample, the impact resistance evaluation test was carried out, and then the air tightness evaluation test was carried out while the heating temperature of the seating portion of the test bench was changed from 200° C. to 250° C. Here, the sample where the air leakage amount from between the metal shell and the insulating insulator was equal to or less than 1 ml/minute maintains extremely good air tightness almost without decrease in axial force due to the impact.

The buckling amount (a value obtained by subtracting the length of the bulge portion along the axis after the caulking process from the length of the portion equivalent to the bulge portion along the axis before the caulking process) of the bulge portion was measured for each sample during the caulking process with the same applied load. The buckling amount equal to or more than 0.7 mm provides a considerably large axial force applied from the metal shell to the insulating insulator, thus achieving extremely excellent air tightness.

Figure 16:
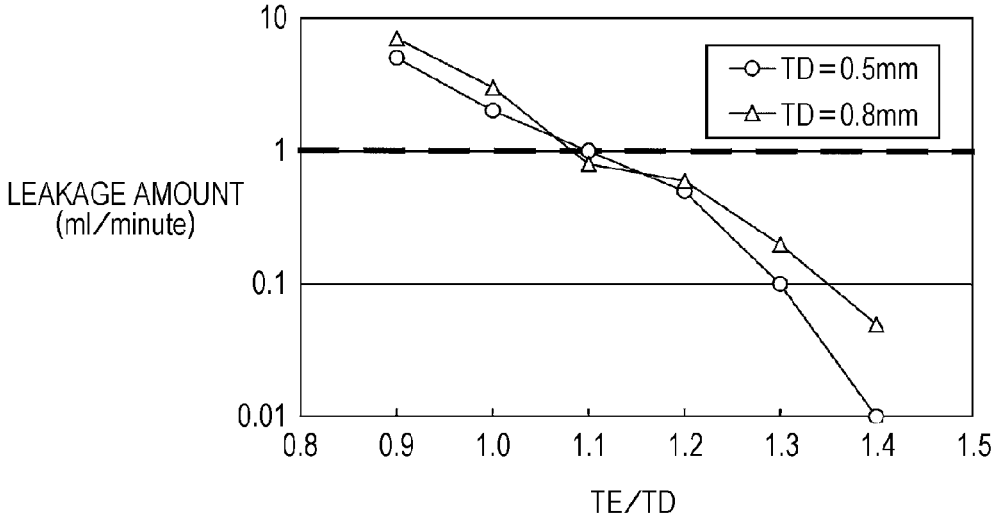
FIG. 16 is a graph showing a relationship between TE/TD and an air leakage amount.
Figure 17:
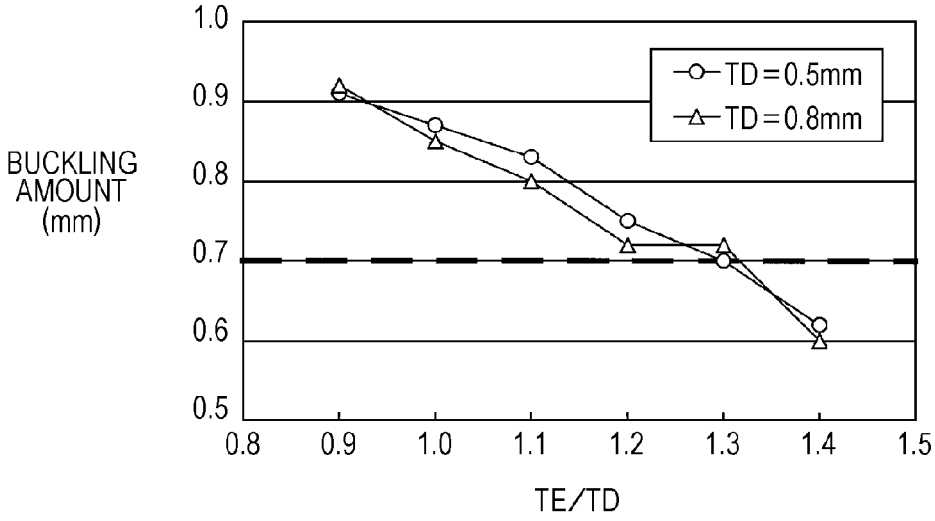
FIG. 17 is a graph showing a relationship between TE/TD and a buckling amount.

FIG. 16 shows the test result of the air tightness evaluation test after the impact resistance evaluation test. FIG. 17 is a graph showing a relationship between TE/TD and the buckling amount of the bulge portion. In FIG. 16 and FIG. 17, a circle mark denotes the test result of the sample with the minimum wall thickness TD of 0.5 mm and a triangle mark denotes the test result of the sample with the minimum wall thickness TD of 0.8 mm. Both the samples were set to have the thread size of M12 in the thread portion, SB/SC of 3.5, SB/LB of 10, SC/LC of 10, the length LA of 18 mm, and the wall thickness TB of 3 mm in the seat portion.

As shown in FIG. 16, the sample satisfying 1.1≤TE/TD has leakage amount equal to or less than 1 ml/minute. It has been demonstrated that excellent air tightness is maintained also during application of the impact. It is considered that this is because the minimum wall thickness TE of the caulking portion becomes sufficiently large with respect to the minimum wall thickness TD of the bulge portion corresponding to the size of the axial force so that the caulking portion has rigidity sufficiently resistant to the axial force.

Additionally, as shown in FIG. 17, it has been demonstrated that the sample satisfying TE/TD≤1.3 has the buckling amount equal to or more than 0.7 mm and achieves considerably excellent air tightness. It is considered that this is because restricting excessively large rigidity of the caulking portion allows more surely deforming the portion equivalent to the caulking portion during the caulking process, thus applying a sufficiently large load to the portion equivalent to the bulge portion.

According to the above-described test results, it is preferred that 1.1≤TE/TD≤1.3 be satisfied from the view point of efficiently restricting decrease in air tightness due to the impact and ensuring further excellent air tightness.

Note that the technique is not limited to the description of the embodiment, and may be, for example, implemented as follows. Of course, the other applications and alterations, not exemplified below are also obviously possible.

(a) In the above-described embodiment, the caulking portion 19 is formed without heating of the metal shell 3 in the caulking process (performing what is called a cold-caulking process) to secure the insulating insulator 2 to metal shell 3. In contrast, the insulating insulator 2 and metal shell 3 may be secured together by forming the caulking portion 19 (performing what is called a hot-caulking process) while heating the metal shell 3 with transmission of electricity in the caulking process. In case of performing the cold-caulking process, it is necessary to apply a larger load from the pressing die 55 to the metal shell 3, compared with the case of performing the hot-caulking process. Therefore, the deformation of the seat portion 16 and the protrusion 20 is more prone to occur. Accordingly, it is especially significant that the technical idea of the present invention is employed in the case where the insulating insulator 2 and the metal shell 3 are secured together by performing the cold-caulking process in the caulking process.

(b) While in the above-described embodiment the lock portion 14 is locked to the protrusion 20 via the sheet packing 21, the lock portion 14 may be directly locked to the protrusion 20 without the sheet packing 21.

(c) While the above-described embodiment exemplifies the case where the ground electrode 27 is sealed to the tip end portion of the metal shell 3, this technique is applicable to the case where the ground electrode is formed by cutting a part of the metal shell (or a part of a tip end metal shell preliminarily welded to the metal shell) (for example, JP-A-2006-236906).

(d) While in the above-described embodiment the tool engagement portion 19 has a hexagonal cross section, the shape of the tool engagement portion 18 is not limited to this shape. For example, Bi-Hex (deformed dodecagon) shape (International Organization for Standardization 22977:2005 (E)) may be possible.

REFERENCE LIST

1 spark plug
2 insulating insulator (insulator)
3 metal shell
15 thread portion
16 seat portion
17 bulge portion
19 caulking portion
20 protrusion
31 tapering surface
32 seat-portion outer peripheral surface
33 locked surface
34 protrusion inner peripheral surface
41 internal combustion engine (combustion apparatus)
42 mounting hole
43 seating portion
CL1 axis Having described the invention, the following is claimed:

1. A spark plug, comprising:

a tubular insulator that extends in an axial direction; and a tubular metal shell disposed at an outer periphery of the insulator, wherein the metal shell includes:

a caulking portion disposed in a rear end portion of the metal shell, the caulking portion being bent toward an inner peripheral side;

a bulge portion positioned on a tip end side with respect to the caulking portion, the bulge portion projecting toward an outer peripheral side;

a seat portion positioned on the tip end side with respect to the caulking portion;

a thread portion positioned on the tip end side with respect to the seat portion, the thread portion being threadably mounted on a mounting hole of a combustion apparatus; and a protrusion positioned at an inner periphery on the tip end side with respect to the seat portion, the protrusion projecting toward the inner peripheral side, wherein the insulator has an outer diameter gradually decreasing toward the tip end side, the insulator including a lock portion directly or indirectly locked to the protrusion, the insulator being secured to the metal shell in a state held between the caulking portion and the protrusion, the seat portion has an outer diameter gradually decreasing toward the tip end side, the seat portion including a tapering surface that at least partially contact a seating portion of the combustion apparatus when the thread portion is threadably mounted on the mounting hole of the combustion apparatus, and $SB/SC \geq 3.5$, $SB/LB \leq 12.0$, and $SC/LC \leq 12.0$ are satisfied in a case where:

the thread portion has a thread size equal to or less than M12;

the tapering surface has an area of SB ($mm^2$);

a length of a seat-portion outer peripheral surface along the axis is LB (mm), the seat-portion outer peripheral surface being a surface extending from a rear end of the tapering surface toward the rear end side along the axis in the seat portion;

a locked surface has an area of SC ($mm^2$), the locked surface being positioned on the inner peripheral side with respect to a rear end of the lock portion in the protrusion, the locked surface locking the lock portion; and a protrusion inner peripheral surface has a length of LC (mm) along the axis, the protrusion inner peripheral surface being a surface extending from a tip end of the locked surface toward the tip end side along the axis in the protrusion.

2. The spark plug according to claim 1, wherein $5.0 \leq SC/LC \leq 10.0$ is satisfied.

3. The spark plug according to claim 1 or 2, wherein a distance from the rear end of the tapering surface to a rear end of the protrusion along the axis is equal to or more than 16 mm.

4. The spark plug according to claims 1 or 2, wherein $TD \geq 0.5$ and $TB/TD \geq 4.2$ are satisfied in a case where a wall thickness of the seat portion is TB (mm) at the rear end of the tapering surface, and a minimum wall thickness of the bulge portion is TD (mm).

5. The spark plug according to claims 1 or 2, wherein $1.1 \leq TE/TD \leq 1.3$ is satisfied in a case where a minimum wall thickness of the bulge portion is TD (mm), and a minimum wall thickness of the caulking portion is TE (mm).

6. The spark plug according to claim 3, wherein $TD \geq 0.5$ and $TB/TD \geq 4.2$ are satisfied in a case where a wall thickness of the seat portion is TB (mm) at the rear end of the tapering surface, and a minimum wall thickness of the bulge portion is TD (mm).

7. The spark plug according to claim 3, wherein $1.1 \leq TE/TD \leq 1.3$ is satisfied in a case where a minimum wall thickness of the bulge portion is TD (mm), and a minimum wall thickness of the caulking portion is TE (mm).

8. The spark plug according to claim 4, wherein $1.1 \leq TE/TD \leq 1.3$ is satisfied in a case where a minimum wall thickness of the bulge portion is TD (mm), and a minimum wall thickness of the caulking portion is TE (mm).

* * * * *